US006027334A

United States Patent [19]

Blaschke

[11] Patent Number: 6,027,334

[45] Date of Patent: Feb. 22, 2000

[54] EVAPORATION BURNER FOR A HEATER

[75] Inventor: Walter Blaschke, Esslingen, Germany

[73] Assignee: J. Eberspächer GmbH & Co., Germany

[21] Appl. No.: 08/836,543

[22] PCT Filed: Nov. 3, 1995

[86] PCT No.: PCT/DE95/01546

§ 371 Date: Apr. 30, 1997

§ 102(e) Date: Apr. 30, 1997

[87] PCT Pub. No.: WO96/15408

PCT Pub. Date: May 23, 1996

[30] Foreign Application Priority Data

Nov. 10, 1994 [DE] Germany ..... 44 40 152

[51] Int. Cl.[7] ..... F23Q 3/00; F23D 11/44; F24H 3/00

[52] U.S. Cl. ..... 431/261; 431/263; 431/326; 431/335; 431/350; 126/116 R

[58] Field of Search ..... 431/261, 260, 431/263, 264, 326, 327, 328, 329, 330, 266, 259, 238, 335, 338, 196, 10, 182, 350; 126/96, 95, 116 R, 110 B; 237/12.3 C

[56] References Cited

U.S. PATENT DOCUMENTS

| | | | |
|---|---|---|---|
| 1,336,261 | 4/1920 | Scott | 431/196 |
| 1,542,326 | 6/1925 | Sawyer | 431/196 |
| 1,650,342 | 11/1927 | Good | 431/266 |
| 1,960,845 | 5/1934 | Gilbert | 431/263 |
| 2,052,514 | 8/1936 | Kinsman | 431/326 |
| 2,240,379 | 4/1941 | Sherman | 431/263 |
| 2,388,908 | 11/1945 | Lancey | 431/328 |
| 3,134,423 | 5/1964 | Smith | 431/259 |
| 3,159,201 | 12/1964 | Hottenroth et al. | 431/263 |
| 3,531,229 | 9/1970 | Berglund | 431/326 |
| 3,975,141 | 8/1976 | Sweet | 431/182 |
| 4,118,171 | 10/1978 | Flanagan et al. | 431/10 |
| 4,427,367 | 1/1984 | Yagisawa | 431/182 |
| 4,530,658 | 7/1985 | Panick | 431/328 |
| 4,623,310 | 11/1986 | Kimijima et al. | 431/262 |
| 4,669,974 | 6/1987 | Sawada et al. | 431/263 |
| 4,818,219 | 4/1989 | Widemann et al. | 431/263 |
| 5,082,175 | 1/1992 | Koch et al. | 237/12.3 C |
| 5,192,203 | 3/1993 | Anzawa et al. | 431/335 |
| 5,197,871 | 3/1993 | Yamamoto et al. | 431/326 |

FOREIGN PATENT DOCUMENTS

| | | |
|---|---|---|
| 81063199 | 6/1981 | Germany . |
| 81 06 319 9 | 8/1981 | Germany . |
| 32 28 446 A1 | 2/1984 | Germany . |
| 3228446 | 2/1984 | Germany . |

*Primary Examiner*—Ira S. Lazarus
*Assistant Examiner*—David Lee
*Attorney, Agent, or Firm*—McGlew and Tuttle, P.C.

[57] ABSTRACT

In an evaporation burner with a combustion chamber (1) for a heater or the like with a peripheral boundary wall (29), a front boundary wall (6) and an air-supply nozzle (8) projecting coaxially into the combustion chamber (1) with radial air outlets (9) through the nozzle wall, a guiding device (32) for a whirling air supply is fitted at or upstream of the air supply nozzle (8) of the combustion chamber (1), in which said air supply nozzle has a diaphragm (10) for axial back-flow (R) of the exhaust gas or the air at the center of turbulence of the whirling air supply (L). In an axial extension of the combustion chamber may be fitted a coaxial flame pipe (20), which together with the peripheral boundary wall (2), may constitute a one-piece (deep-drawn) sheet-metal component and the rest of the combustion chamber may be a cast component.

31 Claims, 4 Drawing Sheets

EVAPORATION BURNER FOR A HEATER

FIELD OF THE INVENTION

The present invention pertains to a vaporizing burner with combustion chamber for a heater or for the thermal regeneration of an exhaust gas particle filter, with a circumferential limiting wall, which has a lateral outer socket for accommodating an igniting means, with a front limiting wall, which has a central opening, with an air feed pipe, which extends coaxially into the combustion chamber and has radial air outlets through the wall of the pipe, and with a fuel feed means.

BACKGROUND OF THE INVENTION

Prior-art vaporizing burners have combustion chambers which operate based on the principle that the fuel is applied to a wall or is introduced into a porous material and is evaporated from there and burned. The evaporation, reaction and combustion take place in one space, i.e., they are not separated. The combustion air is either fed directly to the combustion chamber or it is fed in distributed in the entire combustion chamber or radially via holes (over the outer jacket) or via a central air pipe, which is provided with holes and has a flame tube at a certain distance from the outlet of the pipe. The common feature of these combustion chambers is that they have a relatively low output density, i.e., a relatively low outgoing output relative to the volume of the combustion chamber.

SUMMARY AND OBJECTS OF THE INVENTION

The object of the present invention is to provide a vaporizing burner of the type described in the introduction, which can be used in many fields, makes possible an efficient combustion that is different from the combustion according to the above-mentioned prior art, and which especially has a simple and compact design and can be efficiently manufactured and assembled.

According to the invention, a vaporizing burner is provided with a combustion chamber for a heater or for the thermal regeneration of an exhaust gas particle filter. The burner includes a circumferential limiting wall which has a lateral outer socket for accommodating an igniting means. The front limiting wall has a central opening, with an air feed pipe, which extends coaxially into said combustion chamber and has radial air outlets through the pipe wall, and with a fuel feed means. A guide means is provided for feeding in a swirling flow. The guide means is associated with the air feed pipe of the combustion chamber.

Provisions are made, in particular, for associating a guide means with the air feed pipe, and especially for arranging it in front of the said air feed pipe, wherein the said guide means ensures that the combustion air is fed in a swirling flow to the (cylindrical) air feed pipe during the operation of the burner. The swirling flow is a two-dimensional flow, whose principal component extends in the area of the air feed pipe located near the wall, wherein the radial component of the flow is relatively weak, and the axial component of the flow is relatively strong. The radial air outlets through the wall of the pipe ensure that the high tangential velocity component will be deflected and accelerated, wherein the "swirl" is essentially destroyed or a positive or negative residual swirl is established. This leads to an especially good "loading" of the annular space with air, and it increases the efficiency of the combustion. The radial air outlets may be designed as longitudinal slots open at their ends or as closed passage windows in the wall of the pipe and distributed over the circumference of the wall of the pipe, optionally arranged in an oblique position and/or with bent edges in order to establish the above-mentioned (positive or negative) residual swirl.

Provisions are preferably made for designing the guide means for the swirling flow to be established in the form of guide blades, which may be designed, in particular, integrally or in one piece with the air feed pipe, wherein the pipe and the guide blades are made as, e.g., a single cast part.

In a preferred variant of the present invention, a coaxial flame tube, which stabilizes the flame during the operation and is used as a waste gas (hot gas) guide, is arranged downstream of the combustion chamber.

Particularly inexpensive manufacture and assembly of the burner is achieved if the flame tube and the circumferential limiting wall or the combustion chamber jacket are made in one piece, especially as a (deep-drawn) sheet metal part, while the rest of the combustion chamber parts are, in particular, cast parts, preferably a single cast part.

The (deep-drawn) sheet metal part and the cast part can be welded together or be firmly connected to one another via an insulating element, e.g., a flat packing, for "thermal uncoupling." A direct connection of the hot parts is interrupted during the operation of the burner in the latter variant.

The fuel is fed to the annular space of the combustion chamber once via a ring channel arranged on the front side in front of the combustion chamber jacket or alternatively via the lateral outer socket, in which the igniting means, e.g., a glow plug or a sheathed-element glow plug in various positions (obliquely, axially, radially, or tangentially in relation to the axis of the combustion chamber).

A porous lining for evaporating fuel fed in may be provided on the inside of the combustion chamber jacket or at the circumferential limiting wall of the combustion chamber.

The air feed pipe may be closed at its front-side downstream end or, in an advantageous variant, it may be open and be provided with a front diaphragm. The waste gas or the air flows back partially through the central passage opening of the front diaphragm during the operation of the burner in the area of the burner axis or in the turbulence center of the swirling air flow fed in the axial direction and is again fed through the radial air passages in the pipe wall to the annular space of the combustion chamber. This returned waste gas or air flow participates in the combustion at least once more (recirculation), and a combustion generating a small amount of harmful substances with low pollutant emission is established. The diameter of the passage opening and the diaphragm diameter are determined experimentally.

It shall be mentioned that hot waste gas can be returned through the front diaphragm in a closed system (e.g., in a heater) or fresh air can be returned through the front diaphragm in an open system (e.g., in a range).

Speaking of a "downstream" end of the air feed pipe means exclusively the inflow of the combustion air, rather than the axial backflow in the axial opposite direction. This also applies to the definition of the "upstream" end in the introduction to the specification, the description of the figures, as well as in the claims.

The present invention makes it possible to design a burner which has a very simple design, can be manufactured and assembled in a simple manner, and can be operated in a highly efficient manner. The burner is particularly suitable for supplementary heaters, such as auxiliary heaters, parking heaters, ranges, camping cookers, but also for so-called soot burners, in a vehicle catalyst preheater, in refrigerators, field kitchens, domestic heaters or heating equipment in general. The burner is preferably a so-called Bunsen burner with waste gas return, which leads to low-emission combustion. The burner is suitable for multifuel operation. The stress on the components is low, because the diffusion flame in the annular combustion chamber is located between the air feed pipe and the circumferential limiting wall of the combustion chamber. Since the flame pattern is homogeneous, the burner can be operated at high efficiency even in heat exchangers.

Even though a coaxial flame retention baffle or a coaxial flame diaphragm may be provided after the front diaphragm of the air feed pipe in the present invention, such means may be omitted in the case of certain requirements or arrangements.

The ambient air may be drawn in automatically during operation in the case of atmospheric burners or in atmospheric Bunsen burners, and the front diaphragm may also be designed as a flow cone or the like (e.g., in the case of a range).

A homogeneous flame pattern in the annular space between the circumferential limiting wall and the air feed pipe is preferably supported by the liquid fuel being fed in on the front side over the entire circumference of the porous lining, i.e., the fuel fed in can evaporate in the porous lining over the entire jacket circumference in the inward direction into the annular space (gasification zone). To achieve this, the ring channel for the fuel, which is created by a distributor ring of a round or polygonal cross section having beveled areas and is located in a corresponding inner wall pocket in the area of the front limiting wall of the combustion chamber, is preferably provided at the front side at the porous lining. The ring channel has a preferably axial connection for a fuel feed line, which may extend, outside the connection area to the ring channel, bent radially to the outside, i.e., in parallel to the front limiting wall of the combustion chamber.

The distributor ring may have especially uniformly distributed axial perforations in its circumference, wherein the number of the axial perforations is preferably equal to the number of radial air outlets, which are preferably uniformly distributed over the circumference of the air feed pipe.

A transition ring may be arranged between the front side of the porous lining, which may be a wire netting, sintered metal, or the like, and the above-mentioned ring channel in order to compensate manufacturing tolerances, e.g., a triton ring, which is especially absorbent and adaptable.

Consequently, the combustion air is swirled via a guide means and is fed to a central air distributor pipe extending into the combustion chamber. This pipe is provided with radial slots or perforations as well as with a front diaphragm, which can be opened or closed. The combustion air enters the annular combustion chamber radially via the slots. The combustion air fed in three-dimensionally has a high tangential velocity component, which is strongly deflected and accelerated at the radial slots (i.e., the slotted pipe destroys the swirl; it operates as a swirl destroyer). The air cylinder is quasi peeled off and directed. The accelerated air jets leaving the slots form highly turbulent zones (turbulences) in their edge area, which extend up to the wall of the combustion chamber. The highly turbulent zones are formed to the right and left of the slots, i.e., in the area of the webs. The height of the annular space, the width of the slots, the number of slots, and the length of the slots are determined depending on the required burner output.

To achieve optimal combustion with defined combustion chamber attachments, it may be useful for a positive or negative residual swirl to remain in the combustion chamber. This can be achieved by slots arranged obliquely (at a certain angle). The slots will bring about a stronger or weaker deflection of the tangential velocity component.

The front diaphragm in the central air distributor pipe has the task of deflecting the swirling combustion air via the slots. To bring about combustion with low emission, a partial gas flow may be returned via this diaphragm (the diameter of the diaphragm is determined experimentally), and this partial gas flow will again participate in the combustion (recirculation).

To achieve this, the three-dimensional swirling flow in the center of the central air distributor pipe preferably has a flow cone with negative axial velocity component in the area of the diaphragm. The high swirl necessary for this can be generated with a corresponding guide means (blade angle, blade height, number of blades), but this means a higher energy consumption on the part of the blower (e.g., an electrical power consumption in a domestic burner).

If a combustion chamber is required to be operated with a low energy consumption (lowest possible power consumption of the blower) (e.g., vehicle parking heater, range), it is advantageous to do away with the formation of a backflow cone and to completely close the central air distributor pipe. As before, the combustion air is thus also deflected over the slots, but the return of the hot gas does not take place any more.

Thus, there are two burner processes (with or without waste gas recirculation) according to the present invention, which operate according to the same basic principle, have been sufficiently tested and have advantages corresponding to their intended purpose.

The advantage of this air distribution is that if the swirling flow and the air distributor pipe are designed correctly, the combustion takes place in the entire annular combustion chamber and is concluded after a few millimeters, which makes it possible to select a shorter design (higher output density) and to do away with a flame retention baffle. The combustion air feed and distribution is specifically guided and clearly defined. However, it may nevertheless be useful in the case of certain arrangements to use a flame diaphragm to generate additional turbulence for aftermixing and combustion.

As far as the fuel preparation is concerned, air is fed via the central air distributor pipe into the combustion chamber at a certain distance from the bottom of the combustion chamber in a defined zone, which is determined experimentally. The axial zone located between the combustion chamber bottom and the air outlet zone is used as a gasification space. A large part of the fuel is pre-evaporated in this space and is introduced in the gaseous form into the highly turbulent combustion air zone, where it will then react and burn. The fuel remaining in the wall lining is transported in the liquid form into the combustion air zone by capillary action and is evaporated there completely and is burned in the diffusion flame. Due to the advantageous fuel preparation according to the present invention, it is possible to generate a relatively homogeneous combustion (the annular space is completely utilized) in the annular combustion chamber. The combustion is concluded a few mm after the air distributor pipe.

The igniting means is arranged or introduced in or at the gasification space or smoke space. In the ideal case, the igniting means generates an independent igniting flame (pilot flame), which starts the evaporation process in the pre-evaporation zone. The pilot flame continues to burn independently after the igniting aids (sheathed-element glow plug, glow plug) is switched off. The fuel can be fed directly into the combustion chamber or via the igniting means. The igniting means preferably has an igniting air feed means.

The air-guiding components are preferably made of precision casting; these include the guide means, the air distributor pipe and, if necessary, a fastening flange.

In the case of combustion chambers with delayed starting output (time elapsing until the maximum output is reached) and which are required to have a long service life, as well as for manufacturing reasons, it may be advantageous to also manufacture the combustion chamber jacket as well as the hot gas guide pipe (flame tube) from precision castings, in which case the combustion chamber jacket is associated with the air-guiding parts.

Since this design has the drawback that relatively large masses must be heated, and since it is important if certain requirements imposed on the burner to reach a high output as rapidly as possible (auxiliary heater), it is advantageous to separate the combustion chamber jacket and the hot gas guide pipe from the air-carrying parts and to make them of a thin-walled sheet metal. This preferably one-piece part offers the advantage of having low mass, so that it is heated up very rapidly, which is advantageous for the gasification and evaporation process. Another advantage is that the air-guiding part is a smaller component than a complete combustion chamber, and more parts are formed from one casting process, which lowers the unit price.

For thermal uncoupling (remark: air-guiding parts cool or conduct heat to the electric motor), the above-mentioned component may be designed such that an insulator in the form of a packing is introduced between the combustion chamber jacket and the air guide part.

The burner according to the present invention differs from the prior-art burner mentioned in the introduction in the manner of air distribution and feed for the combustion, on the one hand, and, on the other hand, in the manner of mixture preparation as well as in its high output density, i.e., in the possibility of obtaining higher outputs from a comparable combustion chamber volume.

The present invention will be described in greater detail below on the basis of exemplary embodiments, with reference to the enclosed drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
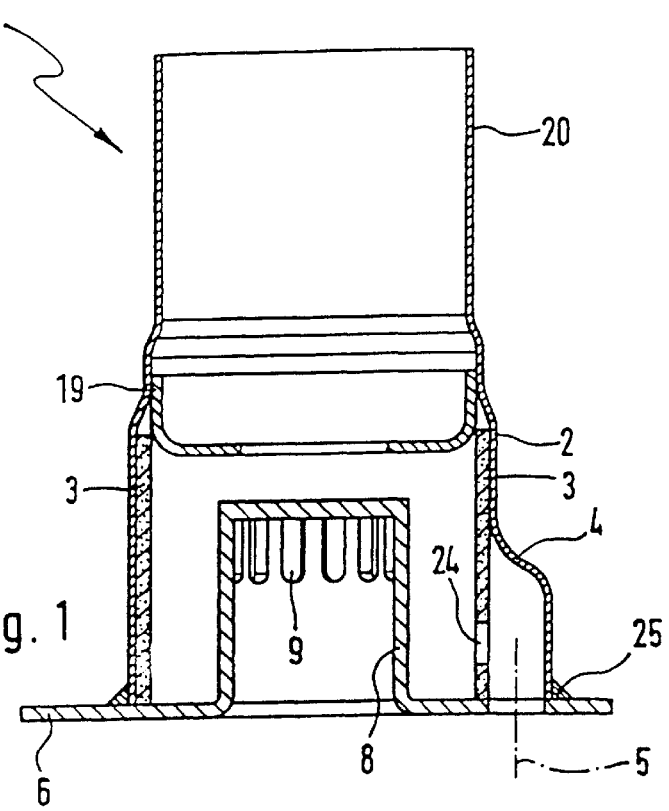
FIG. 1 is a schematic axial sectional view of a vaporizing burner according to the invention.

The vaporizing burner shown in FIG. 1 comprises a cylindrical combustion chamber 1 and a coaxial flame tube 20 in a connection that is open on the top side according to FIG. 1.

The combustion chamber 1 comprises a flat front limiting wall 6, an essentially cylindrical circumferential limiting wall 2, which projects upwardly at right angles from the front limiting wall 6 card defines a combustion space, a cylindrical air feed pipe 8, which extends centrally at right angles from the front limiting wall 6 and is coaxial to the circumferential limiting wall 2, and a porous cylindrical lining 3 arranged at the inner circumference of the circumferential limiting wall 2, wherein an integrated outer lateral socket 4 for accommodating an igniting means 5, e.g., a sheathed-element glow plug, is provided in the circumferential limiting wall 2.

The fuel is also fed to the combustion chamber 1 via the lateral socket 4, as will be described below in connection with FIG. 11.

Figure 2:
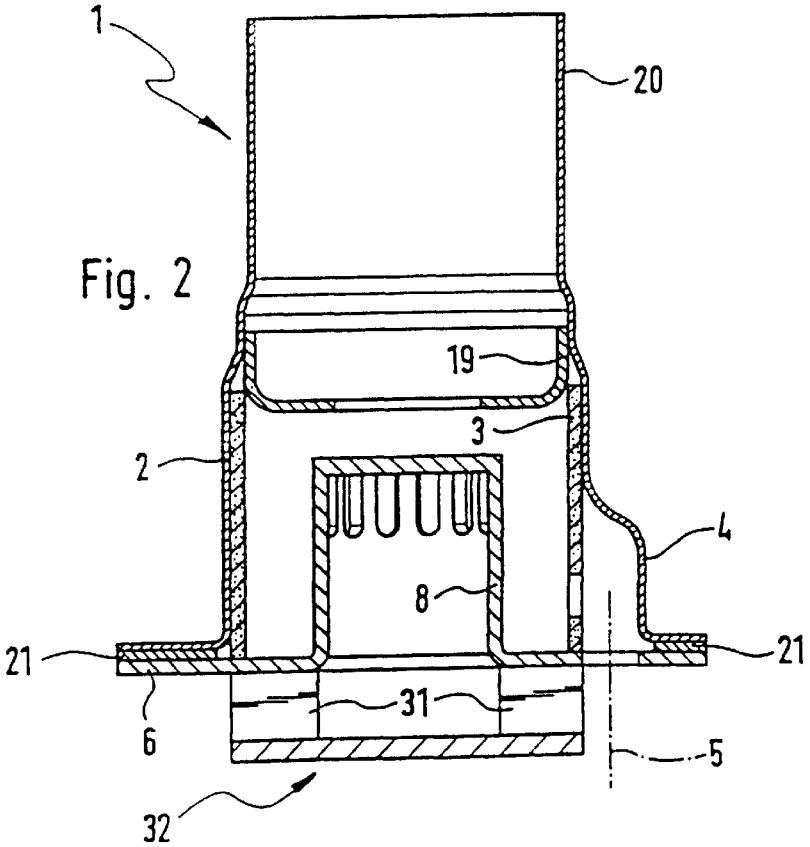
FIG. 2 is a schematic axial sectional view of another vaporizing burner similar to that in FIG. 1.

In the area of the lateral socket 4, the porous lining 3 has at least one radial passage opening or an ignition hole 24 to make possible an ignition or the transition of the flame from the socket 4 into the annular space between the circumferential limiting wall 2 or the porous lining 3 and the air feed pipe 8, with which an integrated guide means 32 with guide blades 31 according to FIG. 2, which guide means is especially a cast part, is associated.

The air feed pipe 8 is made as a precision casting in one piece with the front limiting wall 6 and is closed at its top, i.e., downstream end, but it is provided in this closing area with radial air outlets 9 in the pipe wall, which are distributed on the circumference of the pipe and will be described in greater detail below.

A flame diaphragm 19 or a flame retention baffle with a central opening is arranged coaxially downstream of the air feed pipe 8, and the said flame diaphragm or flame retention baffle is fastened to the inner circumference of the cylindrical circumferential limiting wall 2 via a cylindrical outer flange.

The flame tube 20 and the circumferential limiting wall 2 according to FIG. 1 are made in one piece of sheet metal in the form of a deep-drawn part and are welded to the aforementioned cast part consisting of the front limiting wall 6 and the air feed pipe 8 by means of a circumferential weld seam 25. This makes manufacture and assembly simple. The cast part is comparatively small. As a consequence, relatively many cast parts can be cast in a single casting mold, which reduces the manufacturing costs. It is also advantageous that the air feed pipe 8 is accessible all around (mold extractor). The combustion chamber jacket or the circumferential limiting wall 2 with integrated flame tube 20 made of sheet metal require a relatively small amount of material and they substantially contribute to the reduction of the mass of the burner. On the whole, rapid heat-up of the evaporating surfaces and very good starting behavior are achieved. Smoke formation is slight.

Figure 11:
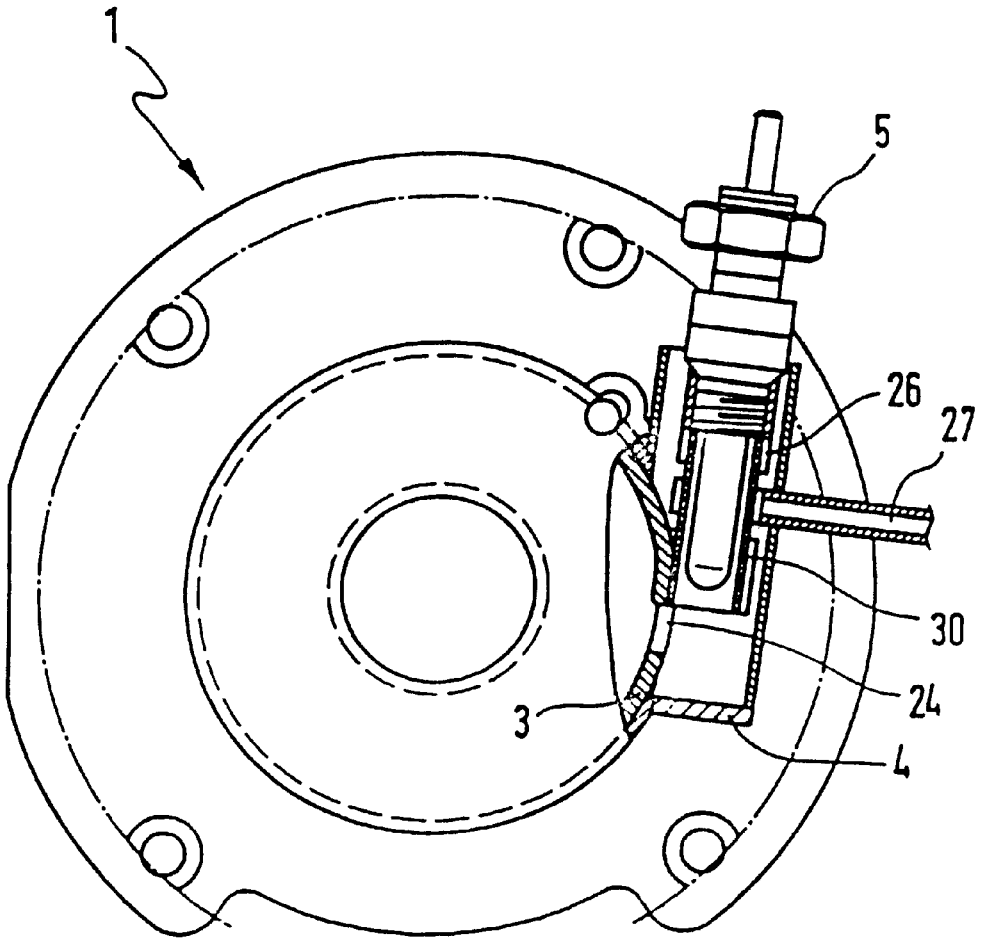
FIG. 11 is a cross sectional view through a vaporizing burner with representation of a lateral igniting means.

The combustion chamber 1 may also be operated without lining 3, contrary to the design variant according to FIG. 1, because the fuel is fed in and is evaporated via the lateral socket 4 of the igniting means 5 (see FIG. 11).

The air feed pipe 8 has the guide means 32 according to FIG. 2 arranged coaxially upstream (according to FIG. 1, bottom), and the said guide means 32 feeds air in a swirling flow into the pipe 8, and the swirling flow is formed mainly on the inner circumference of the air feed pipe 8 and the air is fed into the annular space of the combustion chamber through the radial air passages 9, accelerated with a radially outwardly directed force component, and the annular space is "loaded" with air.

The exemplary embodiment of a vaporizing burner with diffusion flame or of a gasification burner shown in FIG. 2 corresponds essentially to that according to FIG. 1, but the deep-drawn sheet metal part consisting of the flame tube 20 and the circumferential limiting wall 2 and the cast part consisting of the front limiting wall 6 and the air feed pipe 8 as well as of the guide means 32 with the guide blades 31 are not connected by a weld seam 25, but are provided in this area of the circumference with an insulating element 21 arranged between them, wherein the sheet metal part and the cast part are connected to one another firmly and in a sealed manner by fastening means (not illustrated). The sheet metal part and the cast part are thus thermally uncoupled. A direct connection to the hot parts is interrupted.

Figure 3:
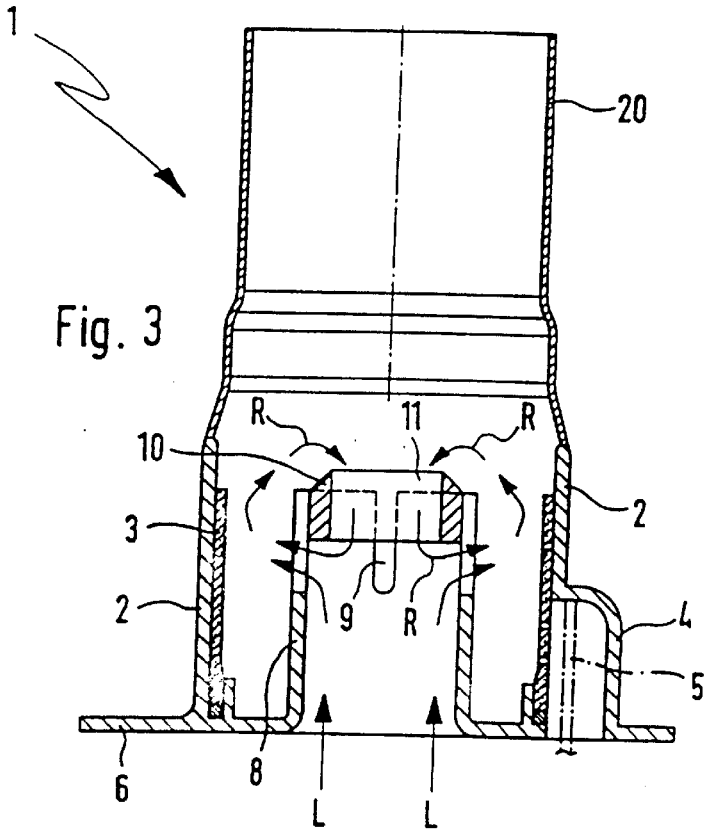
FIG. 3 is a schematic axial sectional view of a third exemplary embodiment of a vaporizing burner similar to that in FIGS. 1 and 2.

The design of the exemplary embodiment shown in FIG. 3 corresponds to that according to FIGS. 1 and 2, but no flame diaphragm 19 is provided here. Furthermore, the circumferential limiting wall 2 is made in one piece here with the front limiting wall 6 and the air feed pipe 8 as a precision casting, while the flame tube 20 is a shaped sheet metal part.

The air feed pipe 8 has at its top end a front diaphragm 10 in the form of a plug, which may also be a plate or a flow cone. The front diaphragm 10 has a central passage opening 11, which extends exactly coaxially to the overall arrangement and forms an axial backflow R for burned combustion air or waste gas, as will be described below.

Figure 4:
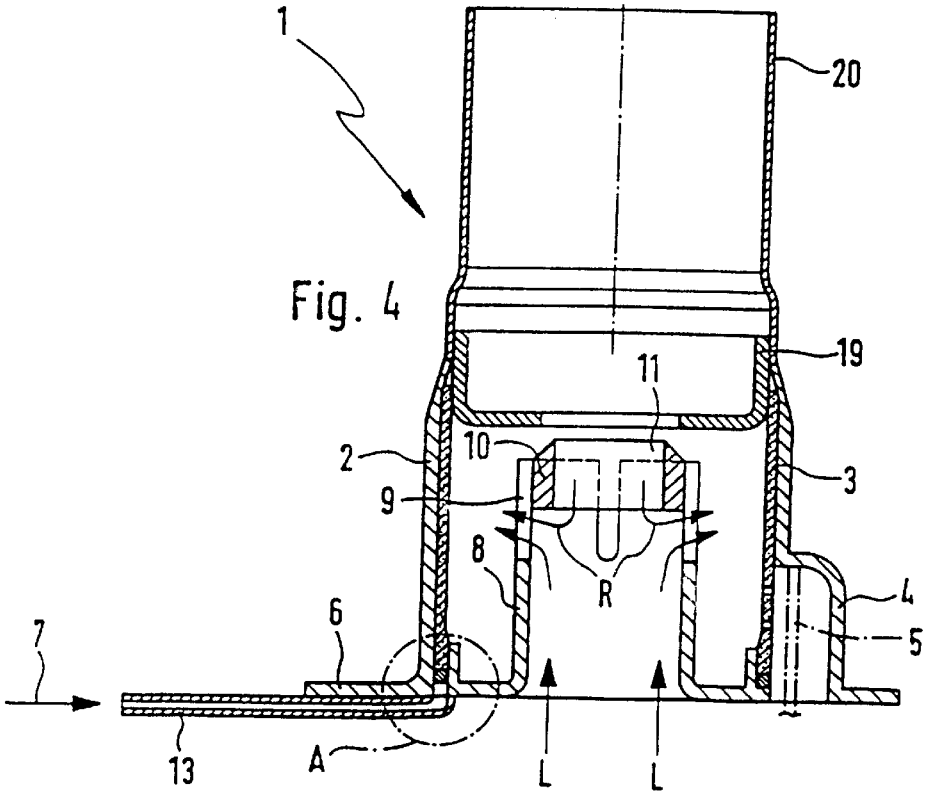
FIG. 4 is a schematic anal sectional view of a fourth design variant according to the invention.

Contrary to the above-mentioned two variants, in which the fuel is fed to the igniting means via the socket 4, the vaporizing burner according to FIG. 3 has a fuel feed means 7 with a fuel feed line 13, as is illustrated, e.g., in the design variant of a vaporizing burner according to FIG. 4, which uses a ring channel 12.

Consequently, the combustion chamber 1 is, in principle, a vaporizing combustion chamber, which is preferably manufactured from a cast, cylindrical combustion chamber housing with bottom, wherein the combustion chamber housing has a pocket for the igniting means, e.g., a sheathed-element glow plug or a glow plug, on the jacket in the axial direction, and the igniting means may extend into the annular space of the combustion chamber obliquely. Additional possibilities of arranging the igniting means will be described in connection with FIG. 11.

Figure 9:
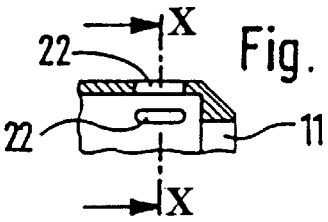
FIG. 9 is a schematic partial sectional view of the downstream end of an air feed pipe with front diaphragm.
Figure 8:
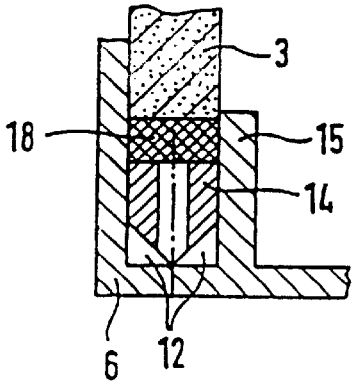
FIG. 8 is a sectional partially perspective view of the design variant according to FIG. 7 with a transition ring in the direction of the porous lining.
Figure 10:
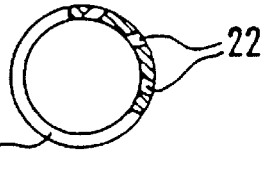
FIG. 10 is a cross sectional view taken at B—B through the air feed pipe according to FIG. 9.

The air feed pipe 8 or the longitudinal slot arrangement, which distributes the air L fed in from below in a swirled pattern uniformly in the radial direction toward the inner jacket of the combustion chamber, is located in the center of the combustion chamber pot, and the swirling flow is preferably generated in an upstream turbulence chamber or in a guide means. The radial air outlets 9 through the wall of the air feed pipe 8 may also be oblique slots as well as other geometric openings with additional deflecting edges or the like, e.g., passage windows 22 according to FIGS. 9 and 10, which have side surfaces at an angle relative to the radial extension (e.g. direction) of the air feed pipe 8.

The combustion air fed in axially is thus a swirling flow L, which has its maximum velocity in an area near the pipe wall and forms a backflow cone in the center in the area of the front diaphragm 10 because of the open front diaphragm 10, which brings about a partial backflow R during combustion. The partial backflow enters the annular combustion chamber ("recirculation") once again through the radial air outlets 9 in the pipe wall and it again participates in the combustion, as a result of which an especially low-emission combustion is ensured.

The partial backflow may be a waste gas return in a closed burner system or, in the case of an open system of an atmospheric burner, it may be the drawing in of ambient air, which will lead to a Bunsen burner.

The front diaphragm may be a plate, a flow cone or the like, and it preferably has a cylindrical, central passage opening 11, which may also be truncated cone-shaped and conically expanded in the direction of the front limiting wall 6.

Figure 5:
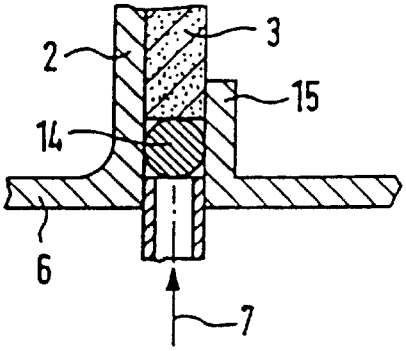
FIG. 5 is a detailed sectional view A from FIG. 4.
Figure 6:
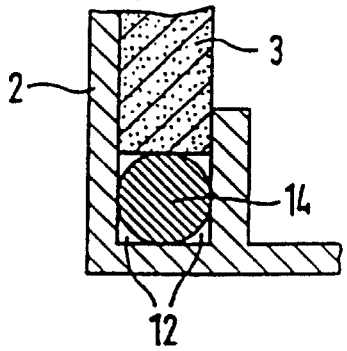
FIG. 6 is a detailed sectional view from FIG. 5 in another area of the circumference.
Figure 7:
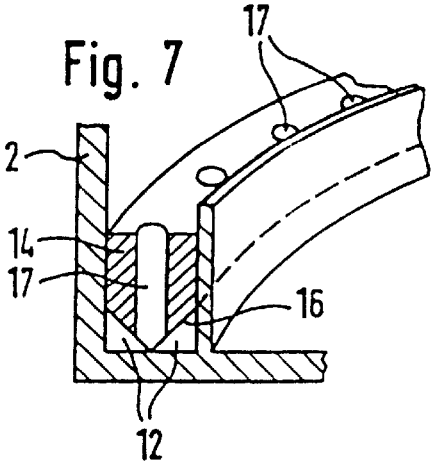
FIG. 7 is a view similar to FIG. 5 of another design of the detail according to FIG. 6.

Since small amounts of fuel are fed in in the case of heaters of low output, the problem of fuel distribution arises. Optimal fuel distribution is necessary to fully utilize the small combustion chamber annular space available. To bring about this fuel distribution with these small amounts of fuel, it is necessary to provide capillaries. The capillaries are prepared as follows:

The fuel feed 7 is via the ring channel 12 according to FIGS. 5 through 8, which is provided at the bottom of the combustion chamber at the inner wall. This ring channel 12 is formed especially in the area of the front limiting wall 6 by a wall pocket 15 inside the combustion chamber, in which pocket a coaxial distributor ring 14 is accommodated. The distributor ring may have a round cross section according to FIGS. 5 and 6, or a rectangular cross section according to FIG. 7. Axial perforations 17, which are distributed uniformly or nonuniformly over the circumference, may extend through the distributor ring 14 in order to supply the downstream side of the ring channel with a sufficient amount of fuel. The porous jacket lining 3, wire netting or the like, as is shown in FIGS. 5 and 6, is arranged above the distributor ring 14, directly joining same, or a transition ring 18, preferably one made of triton or the like is arranged there, which borders on the front side of the porous lining 3 and compensates tolerances in the manufacture of the individual parts.

The fuel is consequently fed in via an annular space, forming an annular channel 12, which may be especially rectangular or trapezoidal and/or may be provided with rounded areas. The fuel is fed into this channel through the bottom of the combustion chamber via the fuel feed line 13 at a certain angle, preferably in the axial direction of the combustion chamber. The ring channel is essentially closed here in the direction of the porous lining in the immediate area of the inlet of the fuel in order to achieve that the entering fuel will be distributed circumferentially to the left and right, and two ring capillaries, which are filled with fuel very rapidly and distribute same in the circumferential direction, are provided on the circumference at the bottom of the combustion chamber. Since there is a narrow gap between the ring channel 12 through the axial passage holes 17 and/or through the gap between the distributor ring 14 and the wall pocket 15, the fuel is discharged in the axial direction upward according to the drawing via these passage holes and gaps and is absorbed by the porous lining (or wire netting or sintered metal) and is fed to the combustion process.

For operation, the igniting means 5, e.g., a glow plug, is heated in the lateral socket 4, and a partial air flow is sent via the lateral socket 4, and this air forms an ignitable mixture with the fuel being evaporated from the porous lining 3 located there. The small igniting flame (pilot flame) heats the annular space of the combustion chamber and then the fuel being evaporated. The combustion air exiting from the slots or windows of the air feed pipe 8 forms a turbulent zone in the radial direction in the area near the wall, with turbulence zones rotating clockwise and counterclockwise. Twelve vortices rotating counterclockwise and 12 vortices rotating clockwise are formed in the case of, e.g., a guide means provided with 12 longitudinal slots. The fuel evaporated by the heat of combustion is caught by these turbulence zones and burned with a blue diffusion flame. The flame fills the entire annular space of the combustion chamber. A larger number of slots are preferably used, because the turbulent zone is thus enlarged. The combustion takes place mostly in the annular space of the combustion chamber between the bottom of the slot, which is in the plane of the cross section, and the height of the slot, as well as between the slots, i.e., in the area of the webs. The combustion is thus concluded in the area of the combustion chamber. The flame tube 20 is used only to guide the hot gas and to homogenize the temperature distribution in the tube, and no fuel burns in this tube any more.

The vaporizing burner according to FIG. 11 illustrates a lateral outer socket 4 for a tangentially arranged igniting means 5, especially a sheathed-element glow plug, especially in a combustion chamber 1 with porous lining 3.

The igniting means may also be located axially or radially inward in relation to the axis of the burner.

Both the igniting air 26 and the fuel 27 are fed in radially around the igniting means 5, which is surrounded with a porous jacket 30 or a screen, wire netting or the like. The ignition of the fuel takes place in the lateral socket 4, and the flame generated is transferred to the annular space of the combustion chamber through the ignition hole 24 in the porous lining 3. Since the porous jacket 30 tightly joins the porous lining 3, the fuel fed to the jacket 30 is also transferred to the porous lining 3, and it evaporates on the inside of the combustion chamber jacket and is ignited by the flame passing through the ignition hole 24.

It should also be mentioned that the independently patentable features contained in the subclaims shall have a corresponding independent protection despite the formal reference to the principal claim. All the inventive features contained in all the application documents also fall within the scope of protection of the present invention.

I claim:

1. A vaporizing burner comprising:

a circumferential wall defining a combustion space, said circumferential wall including a lateral outer socket, which extends radially outwardly of a remaining surface of said circumferential wall;

a front limiting wall element with a front limiting wall with a central opening, said front limiting wall element having an air feed pipe which extends from said front limiting wall central opening coaxially into said combustion space, said air feed pipe having radial air outlets through a wall of said air feed pipe, said front limiting wall and said air feed pipe being a one-piece precision cast part;

a fuel feed means for feeding liquid fuel for combustion into said combustion space;

an igniting means for igniting the fuel for combustion, said igniting means being accommodated in said lateral outer socket; and a flame tube coaxially arranged downstream of said combustion space, said flame tube and said circumferential wall being a one-piece deep-drawn sheet metal part.

2. A vaporizing burner in accordance with claim 1, further comprising:

guide means for feeding in a swirling flow of combustion air, said guide means being positioned upstream of said air feed pipe of said combustion space, said guide means includes guide blades formed integrally and precision cast with said air feed pipe.

3. A vaporizing burner in accordance with claim 1, wherein said deep drawn sheet metal part is welded to said precision cast part.

4. A vaporizing burner in accordance with claim 1, wherein said deep drawn sheet metal part is firmly connected to said precision cast part via an insulating element.

5. A vaporizing burner in accordance with claim 1, wherein said circumferential limiting wall of said combustion space has a porous lining on an inside forming a part of said fuel feed means.

6. A vaporizing burner in accordance with claim 5, wherein said fuel feed means includes a ring channel in the area of said front limiting wall of said combustion space.

7. A vaporizing burner in accordance with claim 6, wherein said ring channel is arranged upstream of a front surface of said porous lining and said ring channel is connected to a fuel feed line, which is located outside of said combustion space and opens into said ring channel in an axial direction of said combustion space.

8. A vaporizing burner in accordance with claim 7, wherein said ring channel is formed by a distributor ring, which is inserted with a clearance into a wall pocket at an upstream end of an inner circumference of said circumferential limiting wall.

9. A vaporizing burner in accordance with claim 8, wherein said distributor ring has a round cross section.

10. A vaporizing burner in accordance with claim 8, wherein said distributor ring has an essentially rectangular, square or trapezoidal cross section, wherein an upstream end has said beveled areas.

11. A vaporizing burner in accordance with claim 8, wherein said distributor ring has axial perforations distributed over a circumference of said distributor ring.

12. A vaporizing burner in accordance with claim 10, wherein a number of said axial perforations corresponds to a number of axial air outlets through a pipe wall of said air feed pipe.

13. A vaporizing burner in accordance with claim 8, wherein a transition ring is arranged between said distributor ring and said porous lining.

14. A vaporizing burner in accordance with claim 13, wherein said transition ring is made of one of triton, a wire netting, and ceramic fibers.

15. A vaporizing burner in accordance with claim 1, wherein said radial air outlets of said air feed pipe are one of:

passage windows distributed over a circumference of said air feed pipe; and longitudinal slots open at a downstream end of said air feed pipe.

16. A vaporizing burner in accordance with claim 15, wherein said one of passage windows and longitudinal slots have side surfaces at an angle in relation to a radial direction of said air feed pipe.

17. A vaporizing burner in accordance with claim 1, wherein said fuel feeding means includes a liquid fuel conduit and a porous lining on an inside of said circumferential wall and said fuel feed means feeds fuel to said porous lining via said lateral outer socket.

18. A vaporizing burner in accordance with claim 1, wherein said air feed pipe is one of:

closed on a front side at a downstream end of said air feed pipe; and provided with a closed front wall.

19. A vaporizing burner in accordance with claim 1, wherein a downstream end of said air feed pipe has a front diaphragm with a central passage opening, wherein said central opening receives an axial backflow of waste gas from a turbulence center of air fed into said combustion space in a swirling flow from said air feed pipe.

20. A vaporizing burner in accordance with claim 19, wherein said front diaphragm is a plate or a conical flow element.

21. A vaporizing burner in accordance with claim 19, wherein said central passage opening of said front diaphragm is truncated cone-shaped, wherein the conical expansion points in an upstream direction, said upstream direction being in a direction of said front limiting wall of said front limiting wall element.

22. A vaporizing burner in accordance with claim 21, wherein said conical expansion contains an inner ring attached to said front diaphragm.

23. A vaporizing burner in accordance with claim 1, wherein one of a flame diaphragm and a flame retention baffle is arranged coaxially downstream of said air feed pipe in said combustion space.

24. A vaporizing burner in accordance with claim 1, wherein said combustion space includes an annular space around said air feed pipe, said igniting means obliquely extending into said annular space.

25. A vaporizing burner in accordance with claim 24, wherein said circumferential limiting wall of said combustion space has a porous lining on an inside of the jacket forming a part of said fuel feed means and wherein said annular space of said combustion space is connected to said socket via at least one ignition hole in said porous lining, said lateral socket with said inner igniting means is arranged axially, tangentially or radially upstream of said annular space of said combustion space.

26. A vaporizing burner, comprising:

a circumferential wall defining a combustion space, said circumferential wall including a lateral outer socket, which extends radially outwardly of said circumferential wall;

a flame tube disposed coaxial to said circumferential wall and connected thereto;

one of a flame diaphragm and a flame retention baffle connected to said circumferential wall and arranged downstream of said air feed pipe;

a front limiting wall element with a front limiting wall with a central opening, said front limiting wall element having an air feed pipe which extends from said front limiting wall central opening coaxially into said combustion space, said air feed pipe having radial air outlets through a wall of said air feed pipe;

a fuel feed means for feeding fuel for combustion into said combustion space, said fuel feeding means including a liquid fuel conduit and a porous lining on an inside of said circumferential wall;

igniting means for igniting the fuel for combustion, said igniting means being accommodated in said lateral outer socket; and guide means for feeding in a swirling flow of combustion air, said guide means being associated with said air feed pipe of said combustion space.

27. A vaporizing burner in accordance with claim 26, wherein said flame tube and said circumferential limiting wall of said combustion space are formed as a one-piece part.

28. A vaporizing burner in accordance with claim 27, wherein said one-piece part is a sheet metal part.

29. A vaporizing burner in accordance with claim 28, wherein said one-piece part is a deep-drawn part.

30. A vaporizing burner in accordance with claim 27, wherein said front limiting wall of said combustion space and said air feed pipe, as well as said guide means are formed as a one-piece cast part.

31. A vaporizing burner comprising:

a circumferential wall defining a combustion space, said circumferential wall including a lateral outer socket, which extends radially outwardly of a remaining surface of said circumferential wall;

a front limiting wall element with a front limiting wall with a central opening, said front limiting wall element having an air feed pipe which extends from said front limiting wall central opening coaxially into said combustion space, said air feed pipe having radial air outlets through a wall of said air feed pipe;

a fuel feed means for feeding liquid fuel for combustion into said combustion space;

an igniting means for igniting the fuel for combustion, said igniting means being accommodated in said lateral outer socket;

guide means for feeding in a swirling flow of combustion air, said guide means being associated with said air feed pipe of said combustion space;

a downstream end of said air feed pipe having a front diaphragm with a central passage opening, wherein said central opening receives an axial backflow of waste gas from a turbulence center of air fed into said combustion space in a swirling flow from said air feed pipe.

* * * * *